US011890526B2

(12) United States Patent
Eaton

(10) Patent No.: US 11,890,526 B2
(45) Date of Patent: Feb. 6, 2024

(54) BASEBALL OR SOFTBALL BATTING GLOVE

(71) Applicant: STINGER BAT CO. LLC, Elmira Heights, NY (US)

(72) Inventor: Brandon Eric Eaton, Clover, SC (US)

(73) Assignee: STINGER BAT CO. LLC, Elmira Heights, NY (US)

( * ) Notice: Subject to any disclaimer, the term of this patent is extended or adjusted under 35 U.S.C. 154(b) by 152 days.

(21) Appl. No.: 17/531,275

(22) Filed: Nov. 19, 2021

(65) Prior Publication Data

US 2022/0193528 A1 Jun. 23, 2022

Related U.S. Application Data

(60) Provisional application No. 63/129,092, filed on Dec. 22, 2020.

(51) Int. Cl.

| | |
|---|---|
| ***A63B 71/14*** | (2006.01) |
| ***A41D 19/00*** | (2006.01) |
| ***A41D 31/14*** | (2019.01) |
| *A63B 102/18* | (2015.01) |

(52) U.S. Cl.

CPC ..... *A63B 71/143* (2013.01); *A41D 19/0006* (2013.01); *A41D 31/145* (2019.02); *A63B 2102/18* (2015.10); *A63B 2102/182* (2015.10); *A63B 2209/00* (2013.01)

(58) Field of Classification Search

CPC ..... A63B 71/143; A63B 2102/18; A63B 2102/182; A41D 19/0006

See application file for complete search history.

(56) References Cited

U.S. PATENT DOCUMENTS

| | | | | |
|---|---|---|---|---|
| D327,754 | S | 7/1992 | Hochgesang | |
| D328,369 | S | 7/1992 | Hong | |
| 5,218,719 | A | 6/1993 | Johnson | |
| 5,644,795 | A * | 7/1997 | Landis | A63B 71/146 2/161.3 |
| D417,312 | S | 11/1999 | Hoefs | |
| 5,983,397 | A | 11/1999 | Seminara | |
| 5,987,642 | A | 11/1999 | Webster | |
| 5,987,646 | A | 11/1999 | Bolmer | |
| 6,088,834 | A | 7/2000 | Seminara | |

(Continued)

FOREIGN PATENT DOCUMENTS

WO WO-2017105992 A1 * 6/2017 ..... A41D 19/0006

*Primary Examiner* — Tajash D Patel

(74) *Attorney, Agent, or Firm* — ROSSI, KIMMS & McDOWELL LLP

(57) ABSTRACT

A batting glove for baseball or softball may include a glove base and a reinforcement layer set. The glove base may include a palmar region, a dorsal region located on an opposite exterior side of the batting glove from the palmar region, a plurality of finger regions, a wrist region at a bottom of the glove base, and an ulnar border region. The ulnar border region may be located along an outermost edge region of the glove base following a length of the little finger region along an outermost side of the little finger region. The reinforcement layer set may be connected to and exterior of the glove base in a manner that covers at least a portion of each of (a) the palmar region, (b) the ulnar border region, and (c) the dorsal region.

19 Claims, 3 Drawing Sheets

(56) References Cited

U.S. PATENT DOCUMENTS

| | | | | |
|---|---|---|---|---|
| 6,513,166 | B1 * | 2/2003 | Landis | A41D 19/01547 2/205 |
| 6,721,960 | B1 * | 4/2004 | Levesque | A63B 71/143 2/161.1 |
| D629,570 | S | 12/2010 | Kanemitsu | |
| 8,132,269 | B1 | 3/2012 | Ibon | |
| D661,842 | S | 6/2012 | Ibon | |
| 8,256,028 | B1 | 9/2012 | Ibon | |
| 9,555,312 | B2 | 1/2017 | Machado | |
| 9,808,038 | B2 | 11/2017 | Long | |
| 10,111,477 | B1 * | 10/2018 | Ballas | A41F 1/06 |
| 2003/0070209 | A1 * | 4/2003 | Falone | B32B 7/022 2/463 |
| 2005/0144698 | A1 * | 7/2005 | Vito | A63B 69/0095 2/161.1 |
| 2013/0036523 | A1 * | 2/2013 | Webster | A41D 19/01523 2/19 |
| 2016/0375344 | A1 | 12/2016 | Restko | |
| 2021/0052968 | A1 * | 2/2021 | Ciaglia | A63B 71/141 |

* cited by examiner

BASEBALL OR SOFTBALL BATTING GLOVE

CROSS-REFERENCE TO RELATED APPLICATION

This application claims the benefit of U.S. Provisional Application No. 63/129,092, filed Dec. 22, 2020, the entire disclosure of which is hereby incorporated herein by reference.

TECHNICAL FIELD

Aspects of this disclosure generally are related to batting gloves for baseball or softball. In some embodiments, a batting glove for baseball or softball includes enhanced durability while maintaining a natural feel.

BACKGROUND

The present inventor recognized that batting gloves for baseball or softball should strive to strike an effective balance between potentially competing functions of durability and natural feeling for the wearer. For example, it may be desirable to have a batting glove be relatively thin to allow the wearer to have a natural feel for the bat, but such thinness tends to negatively impact durability. Further, the present inventor recognized that conventional batting gloves typically include a seam that runs along an outer edge on the pinky or little finger side of the glove, and that such seam typically represents a common failure point in such gloves where ripping and separation occurs. Accordingly, the present inventor recognized that a need in the art exists for improved baseball or softball batting gloves that exhibit improved durability while maintaining a natural feeling for the batter.

SUMMARY

At least the above-discussed need is addressed and technical solutions are achieved in the art by various embodiments of the present invention. In some embodiments, a batting glove for baseball or softball includes a glove base and a reinforcement layer set. The glove base may include a palmar region, a dorsal region located on an opposite exterior side of the batting glove from the palmar region, a plurality of finger regions, a wrist region at a bottom of the glove base, and an ulnar border region. The plurality of finger regions may include a little finger region and a ring finger region adjacent the little finger region. The ulnar border region may be located along an outermost edge region of the glove base following a length of the little finger region along an outermost side of the little finger region. The reinforcement layer set may be connected to and exterior of the glove base in a manner that covers at least a portion of each of (a) the palmar region, (b) the ulnar border region, and (c) the dorsal region.

In a state in which the batting glove is flat with the plurality of finger regions extended and in which the batting glove is viewed in two dimensions from a direction facing and perpendicular to the palmar region, the at least the portion of the palmar region may include at least part of a line segment following a length of the ring-finger region to the wrist region of the glove base. The reinforcement layer set may cover (i) the at least the portion of the palmar region including the at least part of the line segment following the length of the ring-finger region to the wrist region of the glove base, (ii) the at least the portion of the ulnar border region, and (iii) the at least the portion of the dorsal region.

In a state in which the batting glove is flat with the plurality of finger regions extended and in which the batting glove is viewed in two dimensions from a direction facing and perpendicular to the dorsal region, the at least the portion of the dorsal region may include at least part of a line segment following a length of the ring-finger region to the wrist region of the glove base. The reinforcement layer set may cover (i) the at least the portion of the palmar region, (ii) the at least the portion of the ulnar border region, and (iii) the at least the portion of the dorsal region including the at least part of the line segment following the length of the ring-finger region to the wrist region of the glove base.

In a state in which the batting glove is flat with the plurality of finger regions extended and in which the batting glove is viewed in two dimensions from a direction facing and perpendicular to the ulnar border region, the at least the portion of the ulnar border region may include at least a portion of the length of the little finger region along the outermost side of the little finger region. The reinforcement layer set may cover (i) the at least the portion of the palmar region, (ii) the at least the portion of the ulnar border region including the at least the portion of the length of the little finger region along the outermost side of the little finger region, and (iii) the at least the portion of the dorsal region.

At least an exterior surface of the reinforcement layer set may be seamless at least in the at least the portion of the ulnar border region.

At least an exterior surface of the reinforcement layer set may be seamless at least in the at least the portion of the ulnar border region and the at least the portion of the palmar region.

An average thickness of the reinforcement layer set may be within a range of 25%-200% of an average thickness of the glove base underneath the reinforcement layer set. In some embodiments, at each of every location of at least a majority of locations on the reinforcement layer set, the reinforcement layer set does not have a thickness that exceeds 200% of the average thickness of the glove base underneath the reinforcement layer set.

An average material strength of the reinforcement layer set may be the same or stronger than an average material strength of the glove base underneath the reinforcement layer set.

The reinforcement layer set may be made of leather or synthetic leather.

The reinforcement layer set may be made of only a single layer. The glove base underneath the reinforcement layer set may include a material other than a material of the single layer. The single layer may be made of leather or synthetic leather. An average thickness of the single layer of leather or synthetic leather may be within a range of 25%-200% of an average thickness of the glove base underneath the single layer.

The reinforcement layer set may include a breathable material section. The breathable material section may be perforated. The breathable material section may be adjacent the wrist region of the glove base. The reinforcement layer set may include a non-breathable material section in addition to the breathable material section. The breathable material section may be perforated, and the non-breathable material section may be non-perforated. The breathable material section may be adjacent the wrist region of the glove base, and the non-breathable material section may be adjacent the breathable material section at least in a direction toward the little finger region of the glove base.

Various embodiments of the present invention include combinations or subsets of any one or more of the features summarized above or otherwise described herein (which should be deemed to include the figures).

BRIEF DESCRIPTION OF THE DRAWINGS

It is to be understood that the attached drawings are for purposes of illustrating aspects of various embodiments and may include elements that are not to scale. It is noted that like reference characters in different figures refer to the same objects.

DETAILED DESCRIPTION

Figure 1:
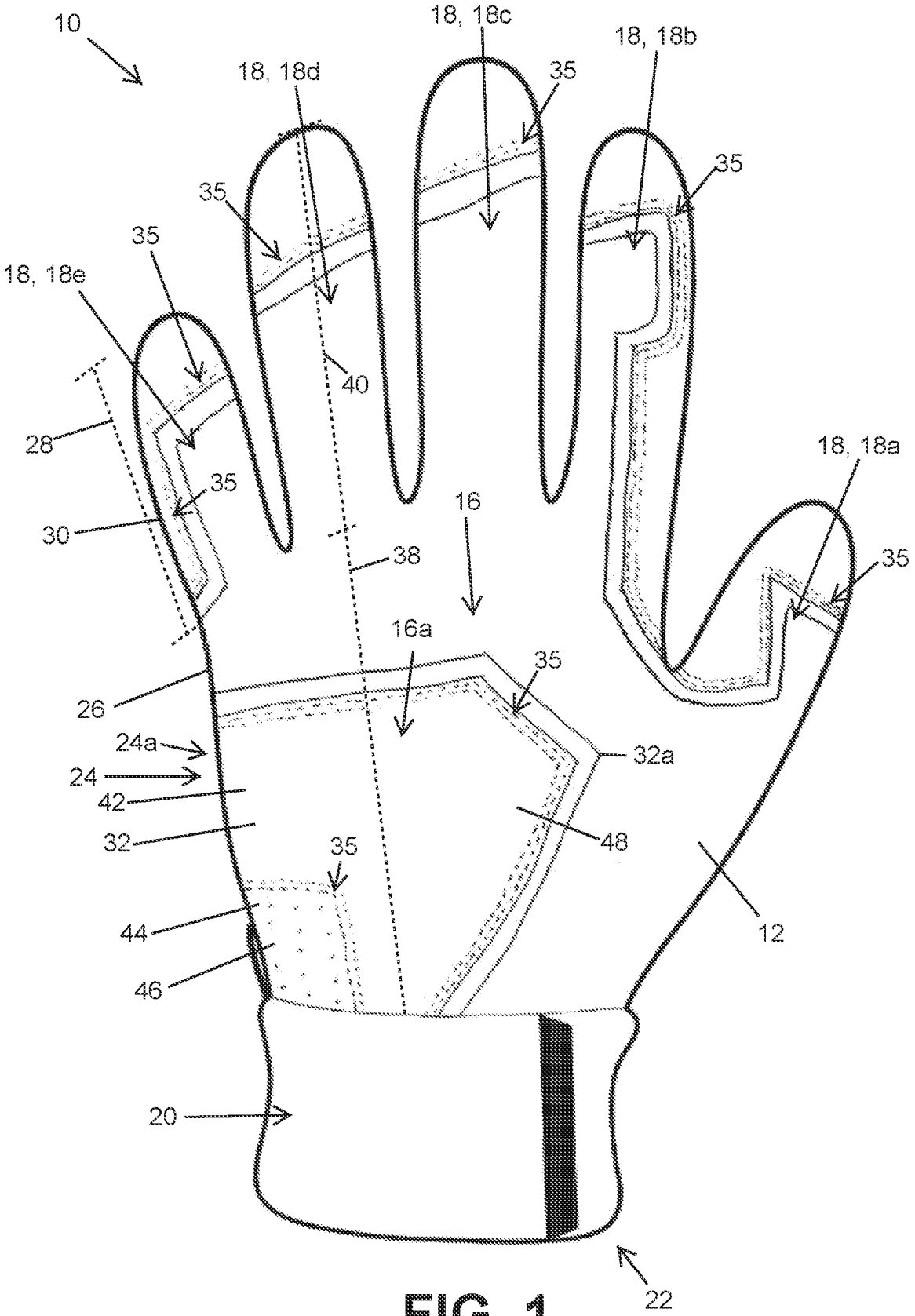
FIG. 1 illustrates a dorsal or back view of a baseball or softball batting glove for a left-hand, according to some embodiments of the present invention.

At least some embodiments of the present invention improve upon conventional baseball or softball batting gloves by improving their durability while maintaining a natural feel for the wearer of the glove. In some embodiments of the present invention, a baseball or softball batting glove (also referred to herein simply as "batting glove" for convenience) includes one or more reinforcement layers that spans at least a portion of a palmar region of the batting glove, wraps around at least the fatty-portion of the side of the hand underneath the pinky- or little-finger, and spans into a dorsal or back region of the hand. Such set of one or more reinforcement layers (also referred to herein as a "reinforcement layer set") may provide reinforcement to a traditionally failure-prone region of the batting glove. For example, such reinforcement layer set may cover and additionally support a seam region along the ulnar border or little-finger side of the glove in order to reduce a risk of failure of such seam. In some embodiments, such seam may be omitted, such that the combination of the absence of such seam and inclusion of the reinforcement layer set may prove to even further increase durability. By having the reinforcement layer set extend into the palmar region of the hand and the dorsal region of the hand, the lateral-most edges of the reinforcement layer set may exhibit a sufficient distance from the traditionally failure-prone ulnar border region to sufficiently reinforce such region. Having such lateral-most edges too close to the ulnar border region may reduce the effectiveness of the reinforcement layer. In some embodiments, the reinforcement layer set does not extend into the palmar region beyond a region beneath the ring finger. Such a feature may help to mitigate any losses in natural feeling of the glove by relatively limiting coverage of the palmar region by the reinforcement layer set, while still providing a sufficient distance between (a) a furthest-edge of the reinforcement layer set in the palmar region from the ulnar border region, and (b) the ulnar border region, in order to sufficiently reinforce the traditionally failure-prone ulnar border region. In some embodiments, the reinforcement layer set is formed on top of a base of the batting glove. The reinforcement layer set may be secured to the base of the batting glove by stitching or adhesion, in some embodiments. In some embodiments, the reinforcement layer set has a thickness approximately equal to that of the base of the batting glove, which may facilitate mitigation of any loss of natural feeling to the batter due to the presence of the reinforcement layer set. These and other features and benefits will become more apparent in light of the following descriptions. It should be noted, however, that the invention is not limited to these or any other examples provided herein, which are referred to for purposes of illustration only.

In this regard, in the descriptions herein, certain specific details are set forth in order to provide a thorough understanding of various embodiments of the invention. However, one skilled in the art will understand that the invention may be practiced at a more general level without one or more of these details. In other instances, well-known structures have not been shown or described in detail to avoid unnecessarily obscuring descriptions of various embodiments of the invention.

Any reference throughout this specification to "one embodiment", "an embodiment", "an example embodiment", "an illustrated embodiment", "a particular embodiment", and the like means that a particular feature, structure or characteristic described in connection with the embodiment is included in at least one embodiment. Thus, any appearance of the phrase "in one embodiment", "in an embodiment", "in an example embodiment", "in this illustrated embodiment", "in this particular embodiment", or the like in this specification is not necessarily all referring to one embodiment or a same embodiment. Furthermore, the particular features, structures or characteristics of different embodiments may be combined in any suitable manner to form one or more other embodiments.

Unless otherwise explicitly noted or required by context, the word "or" is used in this disclosure in a non-exclusive sense. In addition, unless otherwise explicitly noted or required by context, the word "set" is intended to mean one or more. For example, the phrase, "a set of objects" means one or more of the objects. In some embodiments, the word "subset" is intended to mean a set having the same or fewer elements of those present in the subset's parent or superset. In other embodiments, the word "subset" is intended to mean a set having fewer elements of those present in the subset's parent or superset. In this regard, when the word "subset" is used, some embodiments of the present invention utilize the meaning that "subset" has the same or fewer elements of those present in the subset's parent or superset, and other embodiments of the present invention utilize the meaning that "subset" has fewer elements of those present in the subset's parent or superset.

Further, the phrase "at least" is or may be used herein at times merely to emphasize the possibility that other elements may exist besides those explicitly listed. However, unless otherwise explicitly noted (such as by the use of the term "only") or required by context, non-usage herein of the phrase "at least" nonetheless includes the possibility that other elements may exist besides those explicitly listed. For example, the phrase, 'based at least on A' includes A as well as the possibility of one or more other additional elements besides A. In the same manner, the phrase, 'based on A' includes A, as well as the possibility of one or more other additional elements besides A. However, the phrase, 'based only on A' includes only A. Similarly, the phrase 'configured at least to A' includes a configuration to perform A, as well as the possibility of one or more other additional actions besides A. In the same manner, the phrase 'configured to A' includes a configuration to perform A, as well as the possibility of one or more other additional actions besides A. However, the phrase, 'configured only to A' means a configuration to perform only A.

Figure 2:
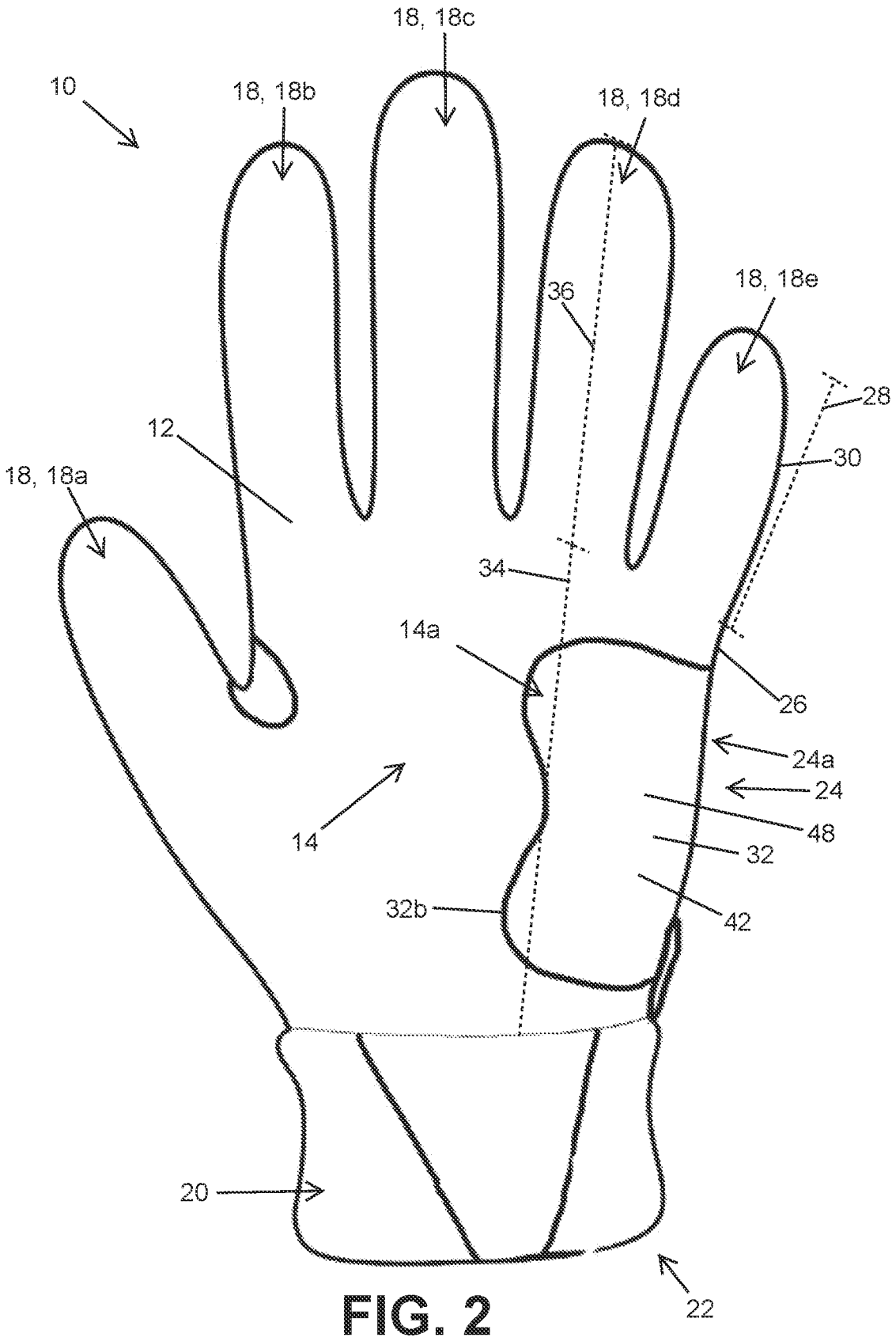
FIG. 2 illustrates a palmar or volar (e.g., "front") view of the baseball or softball batting glove of FIG. 1, according to some embodiments of the present invention.
Figure 3:
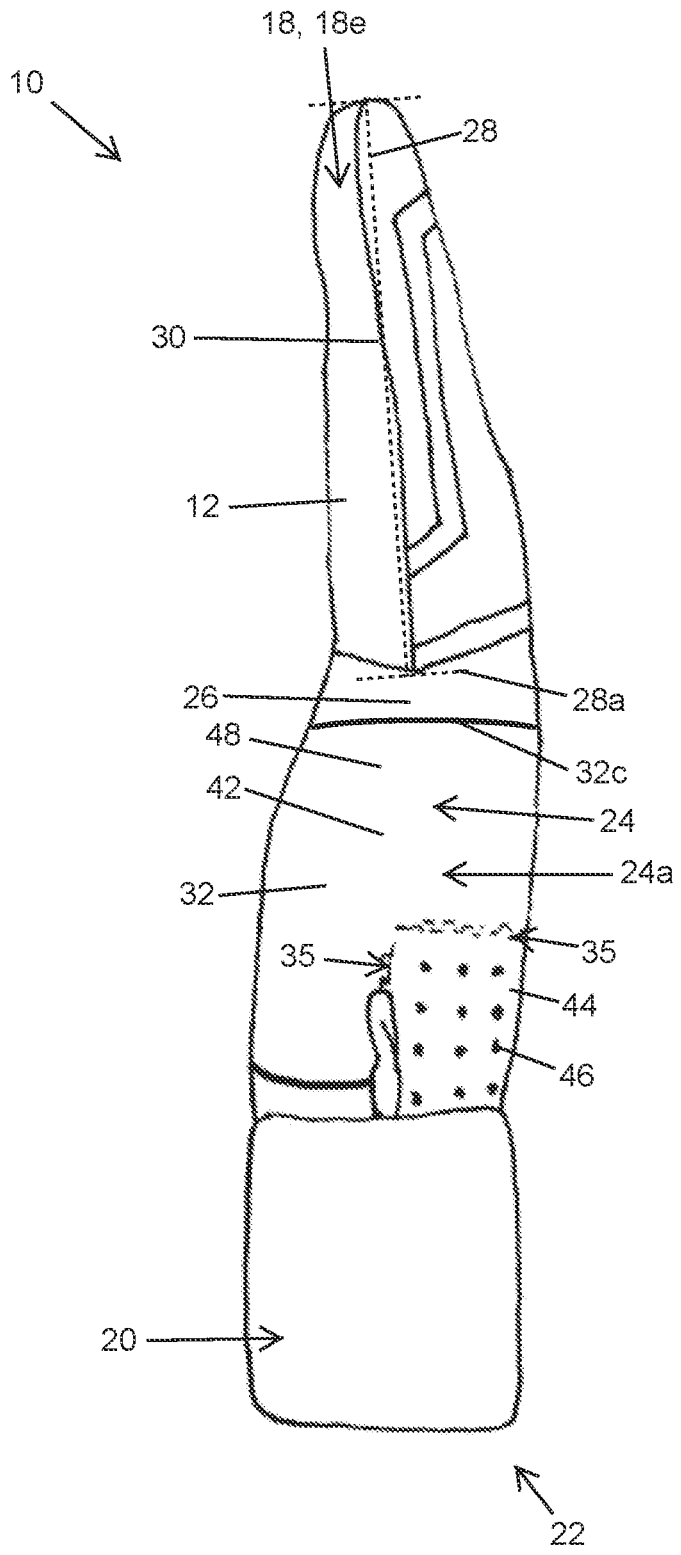
FIG. 3 illustrates an ulnar border or pinky- or little-finger side view of the baseball or softball batting glove of FIG. 1, according to some embodiments of the present invention.

FIG. 1 illustrates a dorsal or back view of a baseball or softball batting glove 10 for a left-hand, according to some embodiments of the present invention. Although right-handed gloves are not illustrated in the figures, it is to be understood that right-handed gloves are included within the scope of the present invention and, in various embodiments, may appear as mirror images of FIGS. 1-3. In this regard, anything described herein with respect to a left-handed glove is to be understood to equivalently apply to a right-handed glove. FIG. 2 illustrates a palmar or volar (e.g., "front") view of the batting glove 10, according to some embodiments, and FIG. 3 illustrates an ulnar border or pinky (little) finger side view of the batting glove 10, according to some embodiments. It is noted that like reference characters in different figures refer to the same objects, so if an object cannot be seen in the view of one figure, it can be seen in the view of another figure.

In some embodiments, the batting glove 10 includes a glove base 12 and a reinforcement layer set 32. In some embodiments, the glove base 12 is one or more pieces of material sets joined together (for example, by seams or adhesion in some embodiments) to collectively form a glove, each material set including one or more layers of materials. Such materials may include, in various embodiments, leather, synthetic leather, or any other material known in the art to form a baseball or softball batting glove. In some embodiments, the glove base 12 may itself form a baseball or softball batting glove in its own right, even absent the reinforcement layer set 32. In some embodiments, the glove base 12 includes a palmar region 14, a dorsal region 16, a plurality of finger regions 18, and an ulnar border region 24. It is noted that FIGS. 1-3 utilize arrows to point to some portions of the glove base 12 that are underneath (interior of) the reinforcement layer set 32. For example, reference numeral 24 for the ulnar border region 24 of the glove base 12 points toward reinforcement layer set 32. It is understood, however, that the ulnar border region 24 of the glove base 12 is underneath (interior of) the reinforcement layer set 32, according to some embodiments. In some embodiments, the glove base 12 includes a wrist region 20 at a bottom 22 of the glove base 12. In some embodiments, the palmar region 14 is configured to cover the palm of a hand, the dorsal region 16 is configured to cover a back of a hand, the plurality of finger regions 18 are configured to receive or cover respective fingers of a hand, the ulnar border region 24 is configured to cover the side of a hand on which the pinky- or little-finger resides, and the wrist region 20 is configured to cover or support a wrist. In some embodiments, the dorsal region 16 is located on an opposite side (e.g., exterior side) of the batting glove 10 from the palmar region 14. In some embodiments, the plurality of finger regions 18 include a thumb-finger region 18*a*, an index-finger region 18*b*, a middle-finger region 18*c*, a ring-finger region 18*d*, and a pinky- or little-finger region 18*e*. For simplicity, since "pinky finger" and "little finger" refer to the same finger, the phrase "little finger" will merely be used. It may be considered that the thumb-finger region 18*a* is adjacent the index-finger region 18*b*, that the index-finger region 18*b* is adjacent the middle-finger region 18*c*, that the middle-finger region 18*c* is adjacent the ring-finger region 18*d*, and that the ring-finger region 18*d* is adjacent the little-finger region 18*e*. In some embodiments, the ulnar border region 24 is located along an outermost edge region 26 of the glove base 12 following a length 28 of the little-finger region 18*e* along an outermost side 30 of the little-finger region 18*e*.

In some embodiments, the reinforcement layer set 32 is connected to and exterior of the glove base 12 in a manner that covers at least a portion (e.g., portion 14*a* in some embodiments) of the palmar region 14, at least a portion (e.g., portion 24*a* in some embodiments) of the ulnar border region 24, and at least a portion (e.g., portion 16*a* in some embodiments) of the dorsal region 16. By having the reinforcement layer set 32 extend into the palmar region 14 and the dorsal region 16, the lateral-most edges 32*a*, 32*b* of the reinforcement layer set 32 may exhibit a sufficient distance from the ulnar border region to sufficiently reinforce such region. In some embodiments, the reinforcement layer set 32 is connected to the glove base 12 by stitching (e.g., some instances of stitching 35) or adhesion. In some embodiments, such stitching is located at least along the exterior edge of the reinforcement layer set 32.

In some embodiments, in a state in which the batting glove 10 is flat with the plurality of finger regions 18 extended and in which the batting glove 10 is viewed in two dimensions from a direction facing and perpendicular to the palmar region 14 (e.g., the view illustrated by FIG. 2), at least the portion 14*a* of the palmar region 14 covered by the reinforcement layer set 32 includes at least part of a line segment 34 that follows a length 36 of the ring-finger region 18*d* to the wrist region 20. In this regard, in some embodiments, the reinforcement layer set 32 covers (i) the at least the portion 14*a* of the palmar region 14 including the at least part of the line segment 34 following the length 36 of the ring-finger region 18*d* to the wrist region 20, (ii) the at least the portion 24*a* of the ulnar border region 24, and (iii) the at least the portion 16*a* of the dorsal region 16. When it is stated that the reinforcement layer set 32 includes at least part of such line segment 34, it is to be understood that the line segment 34 is merely a mathematical or geometric construct used to define a location of the portion 14*a* of the palmar region 14, and that such line segment 34 is not physical in nature. In this regard, with the exception of the illustrated stitching 35 and perforations 46 (only one perforation 46 called out in each of FIG. 1 and FIG. 3 for purposes of clarity), any other element illustrated in the figures in broken line, such as line segment 34 or length 36, is such a mathematical or geometric construct to indicate the position of an object, and such construct is not physical in nature. Although FIGS. 1-3 illustrate stitching 35 as pairs of rows of stitching, other configurations and positions of stitching may be implemented in various other embodiments.

By having the reinforcement layer set 32 extend into the palmar region 14 at least to the region of line segment 34, it may be determined that the lateral-most edge 32*b* of the reinforcement layer set 32 exhibits at least a sufficient distance from the ulnar border region to sufficiently reinforce such region. If the lateral-most edge on the palmar side (e.g., edge 32*b*) of the reinforcement layer set 32 is too close to the ulnar border region 24, such lateral-most edge may be subject to at least some of the same forces that traditionally cause premature failure in the ulnar border region and, therefore, may have an unacceptably high risk of failure in some contexts and depending on design choices. In some embodiments, the reinforcement layer set 32 does not extend into the palmar region 14 beyond a region beneath the ring-finger region 18*d*. For example, in some embodiments, the reinforcement layer set 32 does not extend into the palmar region 14 beneath the middle-finger region 18*c* ("beneath" meaning between the middle-finger region 18*c* and the wrist region 20 in some embodiments). By not having the reinforcement layer set 32 extend too far into the palmar region 14, such as according to some of these embodiments, a natural feel for the wearer of the glove may be maintained in the remainder of the palmar region 14 not covered by the reinforcement layer set 32, while maintaining sufficient reinforcement of the ulnar border region 24.

In some embodiments, in a state in which the batting glove 10 is flat with the plurality of finger regions 18 extended and in which the batting glove 10 is viewed in two dimensions from a direction facing and perpendicular to the dorsal region 16 (e.g., the view illustrated by FIG. 1), at least the portion 16*a* of the dorsal region 16 covered by the reinforcement layer set 32 includes at least part of a line segment 38 that follows a length 40 of the ring-finger region 18*d* to the wrist region 20 of the glove base 12. In this regard, in some embodiments, the reinforcement layer set 32 covers (a) the at least the portion 14*a* of the palmar region 14, (b) the at least the portion 24*a* of the ulnar border region 24, and (c) the at least the portion 16*a* of the dorsal region 16 including the at least part of the line segment 38 following the length 40 of the ring-finger region 18*d* to the wrist region 20. For similar reasons as discussed above with respect to the palmar region 14, by having the reinforcement layer set 32 extend into the dorsal region 16 at least to the region of line segment 38, it may be determined that the lateral-most edge 32*a* of the reinforcement layer set 32 exhibits at least a sufficient distance from the ulnar border region to sufficiently reinforce such region. If the lateral-most edge of the dorsal side (e.g., edge 32*a*) of the reinforcement layer set 32 is too close to the ulnar border region 24, such lateral-most edge may be subject to at least some of the same forces that traditionally cause premature failure in the ulnar border region and, therefore, may have an unacceptably high risk of failure in some contexts and depending on design choices.

In some embodiments, in a state in which the batting glove 10 is flat with the plurality of finger regions 18 extended and in which the batting glove 10 is viewed in two dimensions from a direction facing and perpendicular to the ulnar border region 24 (e.g., the view illustrated by FIG. 3), the at least the portion 24*a* of the ulnar border region 24 includes at least a portion of the length 28 of the little-finger region 18*e* along the outermost side 30 of the little-finger region 18*e*. In this regard, in some embodiments, the reinforcement layer set 32 covers (a) the at least the portion 14*a* of the palmar region 14, (b) the at least the portion 24*a* of the ulnar border region 24 including the at least the portion of the length 28 of the little-finger region 18*e* along the outermost side 30 of the little-finger region 18*e*, and (c) the at least the portion 16*a* of the dorsal region 16. For example, although FIG. 3 shows the top edge 32*c* of the reinforcement layer set 32 located below (i.e., relatively closer to bottom 22 of glove base 12) the bottom of the little-finger region 18*e* (e.g., represented by the line segment 28*a* representing the bottom of the length 28 of the little-finger region 18*e*), some embodiments may have the top edge 32*c* of the reinforcement layer set 32 be located at least partially within the little-finger region 18*e* to, for example, enhance protection and durability in the little-finger region 18*e*. However, in some embodiments, the reinforcement layer set 32 does not extend into the little-finger region 18*e* as shown in FIGS. 1-3, which may provide a simpler, more easily manufactured design with lower manufacturing costs in some contexts.

In some embodiments, the reinforcement layer set 32 has less than, the same, or approximately the same thickness as the glove base 12, or at least a region of the base 12 underneath the reinforcement layer set 32. For example, in some embodiments, an average thickness of the reinforcement layer set 32 is within a range of 25%-200% of an average thickness of the glove base 12 underneath the reinforcement layer set 32. In some embodiments, at each of every location of at least a majority of locations on the reinforcement layer set 32, the reinforcement layer set 32 does not have a thickness that exceeds 200% in some embodiments, 150% in some embodiments, or 100% in some embodiments, of the average thickness of the glove base 12 underneath the reinforcement layer set 32. In some embodiments, at each of every location on the reinforcement layer set 32, the reinforcement layer set 32 does not have a thickness that exceeds 200% in some embodiments, 150% in some embodiments, or 100% in some embodiments, of the average thickness of the glove base 12 underneath the reinforcement layer set 32. By limiting the thickness of the reinforcement layer set 32 in at least some or all of these manners, any potential negative impact on the natural feel of the glove by the wearer due to the reinforcement layer set 32 may be maintained within an acceptable range.

In some embodiments, an average material strength of the reinforcement layer set 32 is the same or stronger than an average material strength of the glove base 12 underneath the reinforcement layer set 32. Such material strength may be controlled by setting relative thicknesses of the reinforcement layer set 32 and the glove base 12 in instances where the same or similar materials are implemented for the reinforcement layer set 32 and the glove base 12. In instances where a stronger material is used for the reinforcement layer set 32 than the glove base 12, the reinforcement layer set 32 may be able to be made relatively thinner. Some material choices for the reinforcement layer set 32, the glove base 12, or both, may include leather or synthetic leather, although other materials used for baseball or softball batting gloves may be implemented in various embodiments. In this regard, the reinforcement layer set 32 may have one or more layers of materials. For example, in some embodiments, the reinforcement layer set 32 includes only a single layer, and the single layer may include leather, synthetic leather, or another material used for baseball or softball batting gloves. In this regard, in some embodiments where the reinforcement layer set 32 includes only a single layer, the above-discussed relative thickness constraints between the reinforcement layer set 32 and the glove base 12 may apply. For example, an average thickness of the single reinforcement layer may be within a range of 25%-200% of an average thickness of the glove base 12 underneath the single reinforcement layer, etc., according to some various embodiments. And, as discussed above, the reinforcement layer may include the same or different material than the glove base 12 underneath the reinforcement layer, according to some embodiments. In some embodiments in which the reinforcement layer set 32 includes multiple layers, at least one of such layers may include a foam or padding material to provide comfort, extra durability, or extra protection. For example, an outermost layer of the reinforcement layer set 32 may be made of leather or synthetic leather (or other material), and an underlying or innermost layer of the reinforcement layer set 32 may be made of the foam or padding material. In some embodiments, the foam or padding material is sandwiched between an overlying leather or synthetic leather (or other) material provided by the reinforcement layer set 32 and an underlying leather or synthetic leather (or other) material provided either by the reinforcement layer set 32 or the glove base 12 itself.

In some embodiments, the batting glove 10 includes a breathable material section 44. The breathable material section 44 may be adjacent the wrist region 20 of the glove base 12, according to some embodiments. In some embodiments, the breathable material section 44 includes perforations 46 to facilitate airflow. In some embodiments, the breathable material section 44 is made of one or more material layers, which may be the same or different than a material in the reinforcement layer set 32 or the glove base 12. In this regard, in some embodiments, the breathable material section 44 may be formed as part of the reinforcement layer set 32. However, in other embodiments, the breathable material section 44 may be distinct from but attached to the reinforcement layer set 32 (e.g., by stitching 35 or adhesive in some embodiments).

In some embodiments, the reinforcement layer set 32 includes a non-breathable material section 48. Some examples of a non-breathable material are leather or synthetic leather without perforations. Accordingly, the non-breathable material section 48 may be a non-perforated. The non-breathable material section 48 may be adjacent the wrist region 20. In some embodiments, the non-breathable material section 48 is adjacent the breathable material section 44. In some embodiments, the reinforcement layer set 32 includes the non-breathable material section 48 and the breathable material section 44. In some embodiments, the non-breathable material section 48 is adjacent the breathable material section 44 at least in a direction toward the little-finger region 18*e* of the glove base 12.

In some embodiments, an exterior surface 42 of the reinforcement layer set 32 is seamless at least in the portion 24*a* of the ulnar border region 24. In some embodiments, at least the exterior surface 42 of the reinforcement layer set 32 is also seamless in at least a portion 14*a* of the palmar region 14. In some embodiments, an entirety of an interior region of the exterior surface 42 of the reinforcement layer set 32 is seamless. By reducing the occurrences of seams in the reinforcement layer set 32, at least in the ulnar border region, may reduce risk of failure (e.g., ripping or tearing) of the reinforcement layer set 32, at least in some contexts.

Subsets or combinations of various embodiments and features described above provide further embodiments. These and other changes can be made to the invention in light of the above-detailed description and still fall within the scope of the present invention. In general, in the following claims, the terms used should not be construed to limit the invention to the specific embodiments disclosed in the specification. Accordingly, the invention is not limited by the disclosure.

What is claimed is:

1. A batting glove for baseball or softball comprising:

a glove base including a palmar region, a dorsal region located on an opposite exterior side of the batting glove from the palmar region, a plurality of finger regions, a wrist region at a bottom of the glove base, and an ulnar border region, the plurality of finger regions including a little finger region and a ring finger region adjacent the little finger region, and the ulnar border region located along an outermost edge region of the glove base following a length of the little finger region along an outermost side of the little finger region; and a reinforcement layer set connected to and exterior of the glove base in a manner that covers at least a portion of each of (a) the palmar region, (b) the ulnar border region, and (c) the dorsal region, wherein, in a state in which the batting glove is flat with the plurality of finger regions extended and in which the batting glove is viewed in two dimensions from a direction facing and perpendicular to the palmar region, the at least the portion of the palmar region includes at least part of a line segment following a length of the ring finger region to the wrist region of the glove base, and wherein the reinforcement layer set covers (i) the at least the portion of the palmar region including the at least part of the line segment following the length of the ring finger region to the wrist region of the glove base, (ii) the at least the portion of the ulnar border region, and (iii) the at least the portion of the dorsal region.

2. The batting glove of claim 1, wherein the line segment is a first line segment and the length of the ring finger region is a palmar-side length of the ring finger region, wherein, in a state in which the batting glove is flat with the plurality of finger regions extended and in which the batting glove is viewed in two dimensions from a direction facing and perpendicular to the dorsal region, the at least the portion of the dorsal region includes at least part of a second line segment following a dorsal-side length of the ring finger ring finger region to the wrist region of the glove base, and wherein the reinforcement layer set covers (i) the at least the portion of the palmar region including the at least part of the first line segment following the palmar-side length of the ring finger region to the wrist region of the glove base, (ii) the at least the portion of the ulnar border region, and (iii) the at least the portion of the dorsal region including the at least part of the second line segment following the dorsal-side length of the ring finger ring finger region to the wrist region of the glove base.

3. The batting glove of claim 1, wherein, in a state in which the batting glove is flat with the plurality of finger regions extended and in which the batting glove is viewed in two dimensions from a direction facing and perpendicular to the ulnar border region, the at least the portion of the ulnar border region includes at least a portion of the length of the little finger region along the outermost side of the little finger region, and wherein the reinforcement layer set covers (i) the at least the portion of the palmar region including the at least part of the line segment following the length of the ring finger region to the wrist region of the glove base, (ii) the at least the portion of the ulnar border region including the at least the portion of the length of the little finger region along the outermost side of the little finger region, and (iii) the at least the portion of the dorsal region.

4. The batting glove of claim 1, wherein at least an exterior surface of the reinforcement layer set is seamless at least in the at least the portion of the ulnar border region.

5. The batting glove of claim 1, wherein at least an exterior surface of the reinforcement layer set is seamless at least in the at least the portion of the ulnar border region and the at least the portion of the palmar region.

6. The batting glove of claim 1, wherein an average thickness of the reinforcement layer set is within a range of 25%-200% of an average thickness of the glove base underneath the reinforcement layer set.

7. The batting glove of claim 6, wherein, at each of every location of at least a majority of locations on the reinforcement layer set, the reinforcement layer set does not have a thickness that exceeds 200% of the average thickness of the glove base underneath the reinforcement layer set.

8. The batting glove of claim 1, wherein an average material strength of the reinforcement layer set is the same or stronger than an average material strength of the glove base underneath the reinforcement layer set.

9. The batting glove of claim 1, wherein the reinforcement layer set is made of leather or synthetic leather.

10. The batting glove of claim 1, wherein the reinforcement layer set comprises only a single layer.

11. The batting glove of claim 10, wherein the single layer is made of leather or synthetic leather.

12. The batting glove of claim 11, wherein an average thickness of the single layer of leather or synthetic leather is within a range of 25%-200% of an average thickness of the glove base underneath the single layer.

13. The batting glove of claim 11, wherein the glove base underneath the reinforcement layer set comprises a material other than a material of the single layer.

14. The batting glove of claim 1, wherein the reinforcement layer set comprises a breathable material section.

15. The batting glove of claim 14, wherein the breathable material section is perforated.

16. The batting glove of claim 14, wherein the breathable material section is adjacent the wrist region of the glove base.

17. The batting glove of claim 14, wherein the reinforcement layer set comprises a non-breathable material section in addition to the breathable material section.

18. The batting glove of claim 17, wherein the breathable material section is perforated, and the non-breathable material section is non-perforated.

19. The batting glove of claim 17, wherein the breathable material section is adjacent the wrist region of the glove base, and wherein the non-breathable material section is adjacent the breathable material section at least in a direction toward the little finger region of the glove base.

* * * * *